US006354106B1

(12) United States Patent
Kataw

(10) Patent No.: US 6,354,106 B1
(45) Date of Patent: Mar. 12, 2002

(54) FINGER RING FITTING AID

(76) Inventor: Kaled T. Kataw, 157 Highcrest Dr., West Milford, NJ (US) 07480

( * ) Notice: Subject to any disclaimer, the term of this patent is extended or adjusted under 35 U.S.C. 154(b) by 0 days.

(21) Appl. No.: 09/569,925

(22) Filed: May 11, 2000

(51) Int. Cl.[7] ..... A44C 9/02
(52) U.S. Cl. ..... 63/15.6; 63/15.5; 63/15.65
(58) Field of Search ..... 63/15.5, 15.6, 63/15.65

(56) References Cited

U.S. PATENT DOCUMENTS

| | | | | | |
|---|---|---|---|---|---|
| 1,115,764 | A | * | 11/1914 | Applas | 63/15.6 |
| 3,465,544 | A | * | 9/1969 | Tucker | 63/15.6 |
| 3,590,598 | A | * | 7/1971 | Leone | 63/15.6 |
| 4,215,556 | A | | 8/1980 | Mroz | |
| 4,526,016 | A | * | 7/1985 | Cercone | 63/15.6 |
| 5,239,842 | A | * | 8/1993 | Gesensway | 63/15.6 |
| 5,636,531 | A | * | 6/1997 | Miller | 63/15.6 |

FOREIGN PATENT DOCUMENTS

| | | | | |
|---|---|---|---|---|
| GB | 1434513 | * | 5/1976 | 63/15.6 |

* cited by examiner

*Primary Examiner*—B. Dayoan
*Assistant Examiner*—Andrea Chop
(74) *Attorney, Agent, or Firm*—Arthur Jacob

(57) ABSTRACT

A finger ring fitting aid is attached readily to a finger ring and has a sizing member selectively movable between a first position, wherein the sizing member lies outside the finger ring opening to enable unrestricted access to the opening for placement of the ring on a wearer's finger, and a second position, wherein the sizing member lies inside the finger ring opening to constrict the opening to a desired fitted size. A resilient biasing mechanism biases the sizing member into either one of the first and second positions such that movement of the sizing member to either position and retention of the sizing member in either position is accomplished with ease and without requiring any auxiliary tool.

8 Claims, 4 Drawing Sheets

FINGER RING FITTING AID

BACKGROUND OF THE INVENTION

FIELD OF THE INVENTION

The present invention relates generally to finger ring adjuncts and pertains, more specifically, to a fitting aid capable of attachment to a finger ring for enabling selective enlargement of the opening of the ring to facilitate placement on a wearer's finger and subsequent constriction of the opening to fit the ring to the wearer's true ring size.

Finger rings have been used for adornment since well before recorded history and generally have been made available in different sizes for fitting to a particular wearer's finger. A long-recognized problem continues to plague wearers who first must pass a finger ring over a relatively large diameter knuckle portion of the wearer's finger to place the ring at a smaller diameter ring-bearing portion of the finger. Thus, a ring sized to fit the ring-bearing portion of a wearer's finger is difficult, if not impossible, to pass over the larger diameter knuckle portion of the finger. A ring sized to ease passage over the knuckle portion will not seat properly on the ring-bearing portion of the wearer's finger and, consequently, will not be maintained in a circumferential orientation for appropriate display of the ring. Moreover, the larger size is more prone to inadvertent removal and loss. While several proposals have been offered in an effort to solve the above problem, these proposals usually require extensive modification of the structure of the finger ring, with concomitant structural complexity and added expense. In addition, these proposals usually require special tools for placement and removal of a ring. Moreover, such modifications detract from the aesthetic appearance of the ring.

BRIEF SUMMARY OF THE INVENTION

The present invention provides a relatively simple, aesthetically pleasing finger ring fitting aid which accomplishes an appropriate fit on a particular wearer's finger while facilitating selective passage of the ring over the knuckle portion of the finger. As such, the present invention attains several objects and advantages, some of which are summarized as follows: Facilitates the placement of a finger ring upon a wearer's finger, and subsequent removal of the finger ring, while enabling an appropriate fit at the ring-bearing portion of the finger; accomplishes a comfortable and effective seating of a finger ring on a ring-bearing portion of a wearer's finger without interfering with the ability to place the ring on the finger or selectively remove the ring from the finger; facilitates the attainment and retention of an appropriate circumferential orientation of a properly fitted ring on a wearer's finger; avoids the use of complex or obtrusive modifications to the structure of a conventional ring to enable ease of placement and removal while attaining an appropriate fit; provides an arrangement readily adapted to finger rings of different sizes and thicknesses; enables a simple installation without requiring special skills or equipment to modify a conventional finger ring; offers an aesthetically pleasing appearance in an effective functional arrangement; enables ease of operation, without the necessity for auxiliary tools; provides for the positive retention of a first selected configuration for placement or removal of a finger ring, or an alternate selected configuration for an appropriate fitted size; allows ready adjustment to assure a comfortable and effective fit, without affecting the ability to function as an aid to facilitate placement or removal of a finger ring; provides a rugged construction capable of effective performance over a long service life.

The above objects and advantages, as well as further objects and advantages, are attained by the present invention which may be described briefly as a finger ring fitting aid for attachment to a finger ring having a shank and an opening for the reception of a wearer's finger, the finger ring fitting aid enabling selective unrestricted access to the opening for placement of the ring on the finger and subsequent constriction of the opening to facilitate appropriate fitting of the ring to the finger, the finger ring fitting aid comprising: a sizing member having at least one arcuate arm for location within the opening of the ring to constrict the opening to a fitted size; a mount for attachment to the shank of the ring; a coupler coupling the sizing member with the mount for movement of the arcuate arm between a first position outside the opening, enabling unrestricted access to the opening for reception of the finger within the opening, and a second position inside the opening, wherein the arcuate arm constricts the opening to the fitted size; and a resilient biasing mechanism for selectively resiliently biasing the arcuate arm into either one of the first and second positions so as to facilitate placement of the ring on the finger when the arcuate arm is biased into the first position, and appropriate fitting of the ring to the finger when the arcuate arm is biased into the second position.

BRIEF DESCRIPTION OF THE SEVERAL VIEWS OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
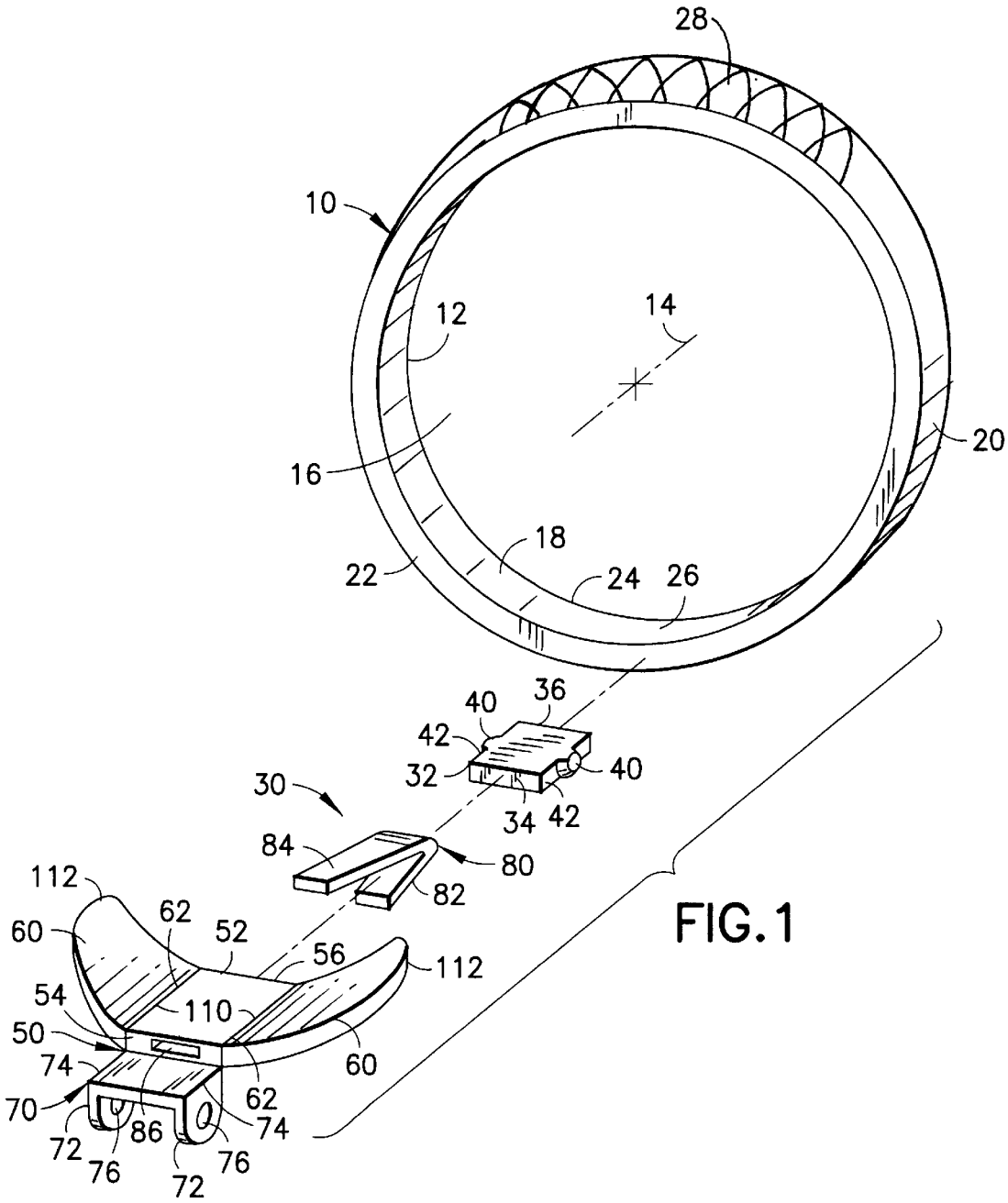
FIG. 1 is an exploded perspective view of a finger ring and a finger ring fitting aid constructed in accordance with the present invention.
Figure 2:
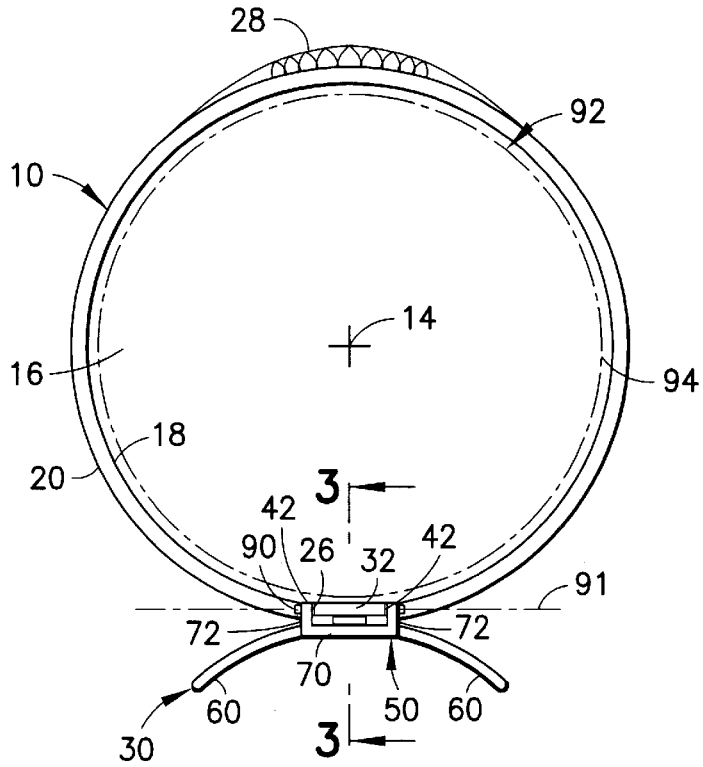
FIG. 2 is an end elevational view of the finger ring fitting aid installed upon the finger ring and illustrated in one operating position.

Referring now to the drawing, and especially to FIG. 1 thereof, a conventional finger ring 10 is illustrated in the form of an annulus 12 having a central axis 14 passing axially through a ring opening 16. Annulus 12 includes an inside surface 18, a radially opposite outside surface 20, and axially opposite end surfaces 22 and 24. A shank 26 is located on the ring 10 along a portion of annulus 12 transversely opposite a crown portion 28 of the ring 10. Ring 10 is to be modified by the addition of a finger ring fitting aid 30 constructed in accordance with the present invention.

Finger ring fitting aid 30 includes a mount shown in the form of a plate 32 having a forward end 34 and a rearward end 36. The plate 32 is to be affixed to the shank 26 of the ring 10, as by soldering or brazing along the rearward end 36 of the plate 32, as illustrated at 38 (see FIG. 3). The plate 32 carries a pair of posts 40 which project in circumferentially opposite directions from corresponding side edges 42 of the plate 32.

Figure 3:
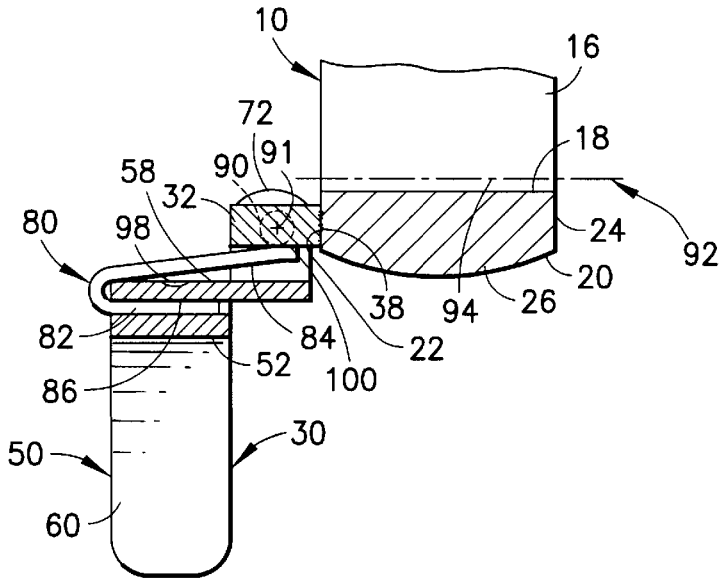
FIG. 3 is an enlarged cross-sectional view taken along line 3—3 of FIG. 2.

A sizing member 50 includes a central section 52 having a forward end 54, a rearward end 56, and a lower face 58 (see FIG. 3). Arcuate arms 60 are integral with the central section 52 and extend in circumferentially opposite directions from corresponding side edges 62 of the central section 52. A coupler 70 is integral with the central section 52 of the sizing member 50 and extends in an axial direction from the forward end 54 of the central section 52. Coupler 70 carries a pair of ears 72 which depend downwardly, in transverse directions, from corresponding opposite sides 74 of coupler 70, each ear 72 including an aperture 76 complementary to a counterpart post 40, for purposes to be described below.

A resilient biasing mechanism is shown in the form of a leaf spring 80 having a first leg 82 and a second leg 84 arranged in a generally J-shaped configuration. A slot 86 extending axially through the central section 52 of sizing member 50 is essentially complementary to the first leg 82 of the leaf spring 80 such that the first leg 82 may be received within the slot 86, thereby placing the second leg 84 beneath the central section 52.

Turning now to FIGS. 2 through 5, with the plate 32 affixed to the shank 26 of the ring 10, such that the mount extends in an axial direction located between the inside and outside surfaces 18 and 20, the sizing member 50 is coupled to the ring 10 by juxtaposing the ears 72 of coupler 70 with the side edges 42 of the plate 32 with the posts 40 received within the apertures 76. The engaged posts 40 and apertures 76 establish a hinge 90 which enables selective pivotal movement of the sizing member 50 about a pivotal axis 91 between a first position, illustrated in FIGS. 2 and 3, wherein the sizing member 50 is outside the opening 16, enabling unrestricted access to opening 16 for the reception of a finger 92 of a wearer, and a second position, illustrated in FIGS. 4 and 5, wherein the sizing member 50 is located inside the opening 16. The pivotal axis 91 extends laterally relative to the axial direction of extent of the mount, and relative to the direction of central axis 14 such that in the second position of the sizing member 50, the arcuate arms 60 are juxtaposed with the inside surface 18 of the annulus 12 and extend essentially circumferentially adjacent the ring 10, within the opening 16, to constrict the opening 16 to a predetermined fitted size smaller than the size of the unrestricted opening 16. Thus, with the sizing member 50 in the first position, ring 10 is placed readily upon the wearer's finger 92 by virtue of the unrestricted opening 16 of a size large enough to pass over the larger diameter encountered at the knuckle portion 94 of the wearer's finger 92. Upon reaching the smaller diameter encountered at the ring-bearing portion 96 of the wearer's finger 92, the sizing member 50 merely is moved to the second position to constrict the opening 16 to the desired fitted size. Placement of the hinge 90 adjacent the end surface 22, and radially between the axial location of inside and outside surfaces 18 and 20, enables finger ring fitting aid 30 to be installed readily on rings of different sizes and having shanks of different thicknesses between inside and outside surfaces 18 and 20, without modification of the finger ring fitting aid 30 itself.

Figure 5:
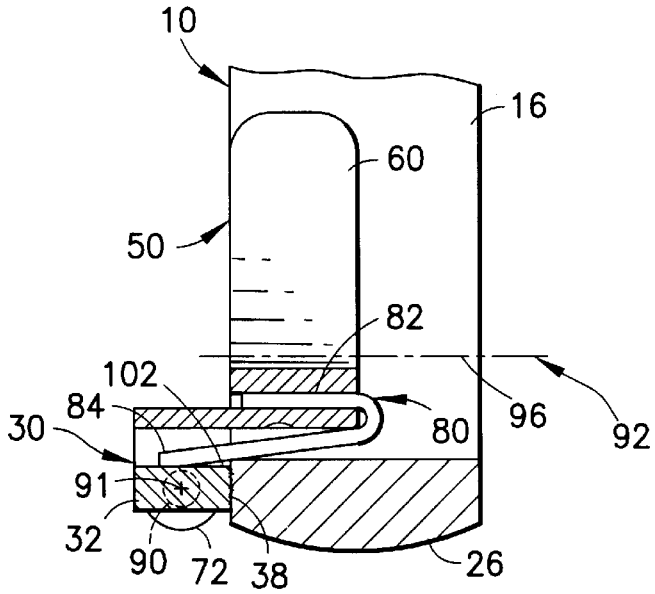
FIG. 5 is an enlarged cross-sectional view taken along line 5—5 of FIG. 4.

The sizing member 50 is resiliently biased into either one of the first and second positions by the over-center arrangement of the leaf spring 80. As best seen in FIGS. 3 and 5, the first leg 82 of the leaf spring 80 is received within the slot 86 in central section 52 and is affixed therein, as by staking the first leg 82 in place within the slot 86, as illustrated at 98. The second leg 84 of the leaf spring 80 extends along the lower face 58 of the central section 52 and projects beneath the plate 32, with the second leg 84 urged against a lower surface 100 of the plate 32 so as to bias the sizing member 50 into the first position, as shown in FIG. 3.

Upon pivotal movement of the sizing member 50 into the second position, as shown in FIG. 5, the second leg 84 of the leaf spring 80 is urged against an upper surface 102 of the plate 32 so as to bias the sizing member 50 into the second position, with the arcuate arms 60 placed within the opening 16 in the ring 10. Selected movement of the sizing member 50 is accomplished readily without the use of auxiliary tools. The described retention of the sizing member 50 in the first position assures ease of placement of the ring 10 on the wearer's finger 92, while retention of the sizing member 50 in the second position attains a secure and comfortable fit and assures proper circumferential orientation of the ring 10 on the finger 92 for appropriate display of the crown portion 28 of the ring 10.

Figure 4:
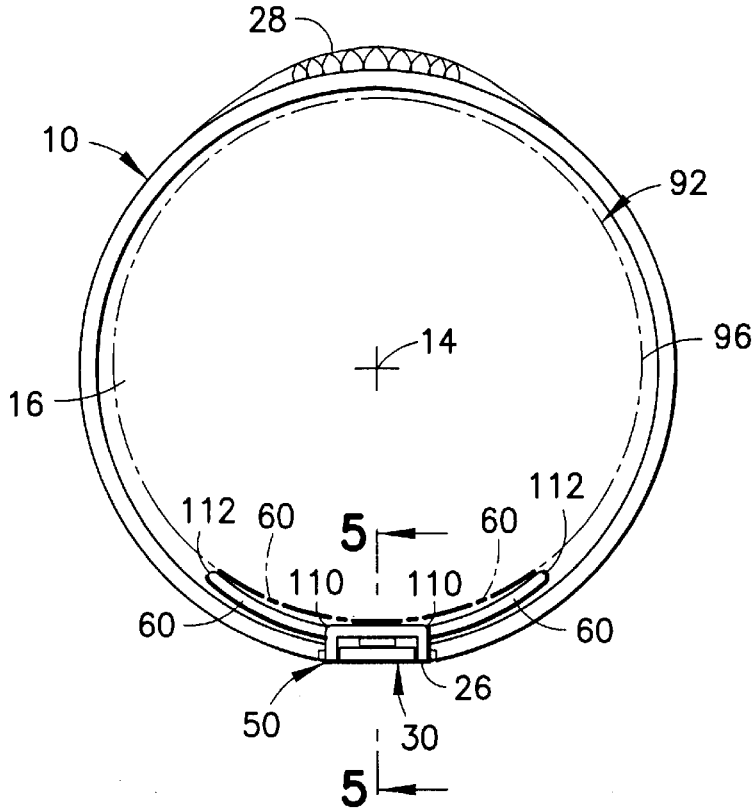
FIG. 4 is an end elevational view similar to FIG. 2, but with the finger ring fitting aid in another operating position.

As best seen in FIGS. 1 and 4, the arcuate arms 60 are in the form of cantilevers extending circumferentially from a root 110, integral with the central section 52 at a corresponding side edge 62, to a remote tip 112 spaced circumferentially from the root 110. Each arcuate arm 60 is spaced radially inwardly from the shank 26 toward the central axis 14 in order to accomplish constriction of the opening 16 to the fitted size. The cantilever construction of the arcuate arms 60 enables fine adjustments to the precise fitted size by merely bending the arcuate arms 60 to the desired constriction, as indicated in phantom in FIG. 4. Such bending of the arcuate arms 60 is accomplished without affecting the ability of the sizing member 50 to be moved into and retained at either one of the first and second positions.

Figure 6:
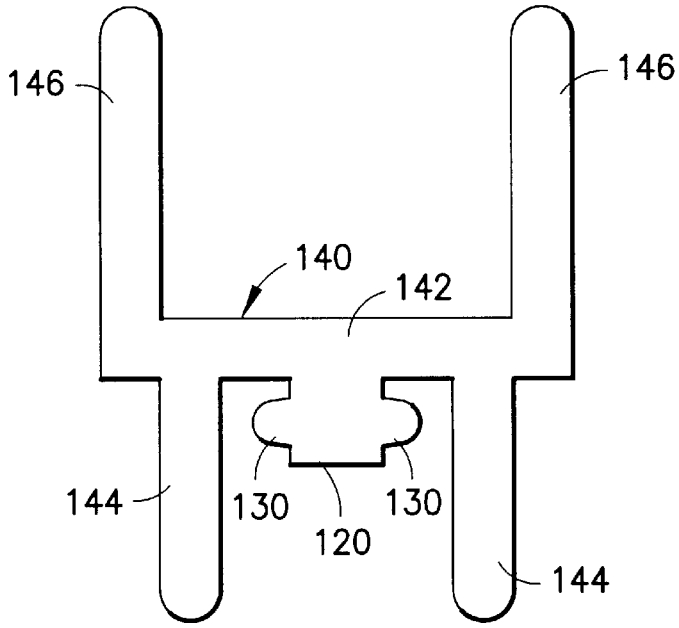
FIG. 6 is a plan view of a component part of an alternate embodiment of the invention.
Figure 7:
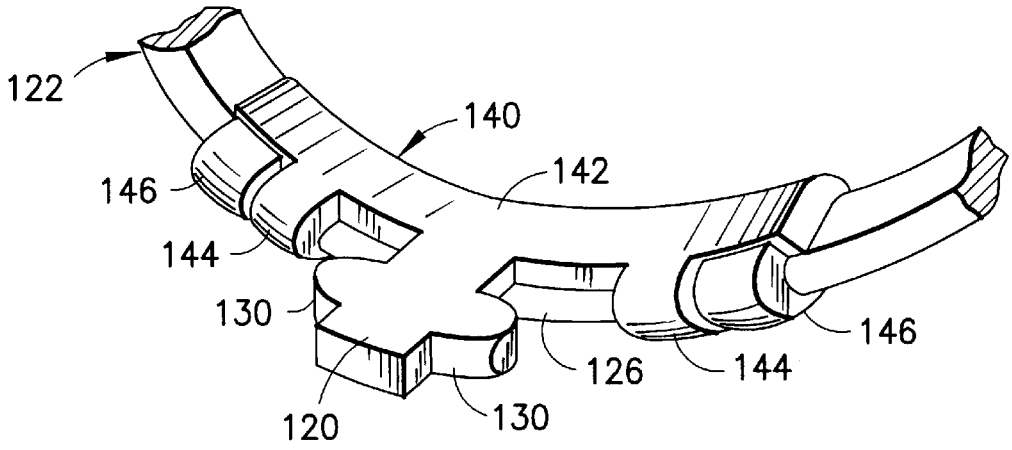
FIG. 7 is a fragmentary perspective view showing the component part of FIG. 6 installed upon a finger ring.

Referring now to FIGS. 6 and 7, another embodiment of the present invention incorporates an alternate mount 120 which can be installed upon a conventional ring 122, at the shank 126 of the ring 122, without the necessity for soldering or brazing, as described in connection with the embodiment of FIGS. 1 through 5. As seen in FIG. 6, mount 120 includes posts 130 and is formed unitary with a bracket 140 having a segment 142 with integral first straps 144 and second straps 146. In order to affix mount 120 to ring 122, the segment 142 is deformed into an arcuate configuration complementary to the shank 126, and the straps 144 and 146 are wrapped around the shank 126 at circumferentially spaced apart locations on the ring 122. The straps 144 and 146 are bent into permanent deformation to secure the bracket 140 in place, thereby affixing the mount 120 to the ring 122 and making the posts 130 available for reception within apertures 76 of the sizing member 50, as described in connection with the embodiment of FIGS. 1 through 5. The strapped connection of the present embodiment enables simplified completion of an installation without requiring soldering or brazing.

It will be seen that the present invention attains the several objects and advantages summarized above, namely: Facilitates the placement of a finger ring upon a wearer's finger, and subsequent removal of the finger ring, while enabling an appropriate fit at the ring-bearing portion of the finger; accomplishes a comfortable and effective seating of a finger ring on a ring-bearing portion of a wearer's finger without interfering with the ability to place the ring on the finger or selectively remove the ring from the finger; facilitates the attainment and retention of an appropriate circumferential orientation of a properly fitted ring on a wearer's finger; avoids the use of complex or obtrusive modifications to the structure of a conventional ring to enable ease of placement and removal while attaining an appropriate fit; provides an arrangement readily adapted to finger rings of different sizes and thicknesses; enables a simple installation without requiring special skills or equipment to modify a conventional finger ring; offers an aesthetically pleasing appearance in an effective functional arrangement; enables ease of operation, without the necessity for auxiliary tools; provides for the positive retention of a first selected configuration for placement or removal of a finger ring, or an alternate selected configuration for an appropriate fitted size; allows ready adjustment to assure a comfortable and effective fit, without affecting the ability to function as an aid to facilitate placement or removal of a finger ring; provides a rugged construction capable of effective performance over a long service life.

It is to be understood that the above detailed description of preferred embodiments of the invention is provided by way of example only. Various details of design and construction may be modified without departing from the true spirit and scope of the invention, as set forth in the appended claims.

What is claimed is:

1. A finger ring fitting aid for attachment to a finger ring having a shank, an opening for the reception of a wearer's finger, and a central axis aligned along an axial direction in which the finger is to be received within the opening, the finger ring fitting aid enabling selective unrestricted access to the opening for placement of the ring on the finger and subsequent constriction of the opening to facilitate appropriate fitting of the ring to the finger, the finger ring fitting aid comprising:

a sizing member having at least one arcuate arm for location within the opening of the ring to constrict the opening to a fitted size;

a mount for attachment to the shank of the ring;

a coupler coupling the sizing member with the mount for movement of the arcuate arm between a first position outside the opening, enabling unrestricted access to the opening for reception of the finger within the opening, and a second position inside the opening, wherein the arcuate arm constricts the opening to the fitted size; and a resilient biasing mechanism for selectively resiliently biasing the arcuate arm into either one of the first and second positions so as to facilitate placement of the ring on the finger when the arcuate arm is biased into the first position, and appropriate fitting of the ring to the finger when the arcuate arm is biased into the second position.

2. The finger ring fitting aid of claim 1 wherein the coupler includes a hinge coupling the sizing member with the mount for pivotal movement of the arcuate arm between the first position and the second position.

3. The finger ring fitting aid of claim 2 wherein:

the sizing member includes a central section having an axially forward end coupled to the mount, and circumferentially opposite sides; and the arcuate arm extends circumferentially from one of the opposite sides, and a further arcuate arm extends circumferentially from the other of the opposite sides, each arcuate arm having a circumferential length extending from a root integral with the central section at a corresponding side of the central section, to a remote tip spaced circumferentially from the root, the arcuate arms being arranged such that upon attachment of the finger ring fitting aid to the finger ring the arcuate arms each will be spaced radially inwardly, along the length of each arcuate arm, from the shank of the finger ring toward the central axis.

4. The finger ring fitting aid of claim 3 wherein the hinge couples the sizing member with the mount for pivotal movement of the arcuate arms about a pivotal axis extending laterally relative to the axial direction.

5. The finger ring fitting aid of claim 3 wherein the resilient biasing mechanism includes an over-center spring affixed to the central section and urged resiliently against the mount to bias the central section selectively into positions corresponding to the first and second positions of the arcuate arms.

6. The finger ring fitting aid of claim 5 wherein the over-center spring includes a leaf spring having a first leg secured to the central section and a second leg urged resiliently against the mount.

7. The finger ring fitting aid of claim 3 wherein the mount includes a bracket having an arcuate segment, and straps integral with the arcuate segment for being wrapped around the shank of the ring to affix the bracket to the ring.

8. The finger ring fitting aid of claim 7 wherein the straps are spaced apart circumferentially for being wrapped around the shank at circumferentially spaced apart locations on the ring.

* * * * *